US005105990A

United States Patent [19]

Leith

[11] Patent Number: 5,105,990

[45] Date of Patent: Apr. 21, 1992

[54] LIQUID DISPENSER

[76] Inventor: Andrew Leith, 77 Valleyview Road, Morningside, Durban, 4001, Natal Province, South Africa

[21] Appl. No.: 463,168

[22] Filed: Jan. 10, 1990

[30] Foreign Application Priority Data

Jan. 19, 1989 [ZA] South Africa ..... 89/0419

[51] Int. Cl.[5] ..... B67D 5/02

[52] U.S. Cl. ..... 222/185; 222/187; 222/189

[58] Field of Search ..... 222/181, 185, 156, 187, 222/189, 83.5, 88; 239/282, 283, 42, 43, 44, 45, 51.5; 141/110, 111

[56] References Cited

U.S. PATENT DOCUMENTS

| | | | |
|---|---|---|---|
| 542,376 | 7/1895 | Bradshaw | 239/43 |
| 3,540,630 | 11/1970 | Brown et al. | 222/181 |
| 3,885,738 | 5/1975 | Chesmel et al. | 239/44 |
| 4,526,320 | 7/1985 | von Phillipp et al. | 239/44 |

FOREIGN PATENT DOCUMENTS

| | | | |
|---|---|---|---|
| 862581 | 2/1971 | Canada | 222/181 |

*Primary Examiner*—Andres Kashnikow
*Assistant Examiner*—Lesley D. Morris
*Attorney, Agent, or Firm*—Fitch, Even, Tabin & Flannery

[57] ABSTRACT

The invention relates to a liquid dispenser that can provide for dampening of cloths and cleaning pads whereby required objects can be cleaned for general cleanliness and hygienic purposes. The dispenser is particularly suitable for use in toilets and like places and comprises a housing for a liquid container, the housing having a well formation into which liquid from the container can be discharged to a controlled level. The liquid in the well formation can be displaced to a contact member of a poriferous material, which can be contacted by a cloth or cleaning pad for dampening thereof, the contact member being located operatively higher than the level of liquid in the well formation. The liquid is displaced to the contact member by a pump, or by a poriferous element by a capillary-type action.

21 Claims, 3 Drawing Sheets

LIQUID DISPENSER

THIS INVENTION relates to a liquid dispenser.

The invention relates in particular to a liquid dispenser that is adapted to provide for dampening of cloths or cleaning pads, and the like, made up of fabric materials, paper, or the like, whereby required objects can be cleaned for general cleanliness and hygienic purposes. It is well known that hygienic conditions in, for example, public toilets, domestic toilets, kitchens, and the like, are not always satisfactory and, therefore, it is an object of this invention to provide a liquid dispenser that can assist to overcome this problem.

According to the invention there is provided a liquid dispenser, which includes an outer housing for supporting a liquid container therein in an inverted configuration, the housing including a well formation into which liquid contained in a liquid container supported in the housing can be discharged to controlled levels;

a contact member of a poriferous material located within the housing and defining a region that is exposed by a first opening in the wall of the housing and that is disposed operatively higher than the controlled liquid levels to which liquid can be discharged into the well formation; and liquid displacement means for displacing liquid contained in the well formation to the region of the contact member that is exposed.

The housing may have a cover displaceable between an open position in which a liquid container can be inserted into the housing, or removed therefrom, and a closed position. Further, the liquid dispenser may include locking means for locking the cover in its closed position.

The contact member may be resiliently compressible so that it can release liquid contained therein by compression thereof via the first opening in a wall of the housing. As such, the contact member may be of a sponge-like material.

Further, the liquid dispenser may include an apertured screen covering the first opening, the apertured configuration of the screen providing the necessary access to the contact member for the release of liquid therefrom. The screen may be resiliently deformable to permit resilient compression of the contact member. Alternatively, the screen may be displaceably located to permit resilient compression of the contact member. According to a preferred embodiment of the invention, the liquid dispenser includes an opposing element, positioned so that the contact member is disposed between the opposing element and the screen, the opposing element locating the contact member in position and permitting compression of the contact member.

Further according to the invention, the liquid dispenser may include a liquid container having an outlet opening, the liquid container being adapted to be housed within the housing in a required inverted configuration in which liquid can be discharged into the well formation to a desired level within the well formation as determined by the level of the outlet opening of the container within the well formation.

The position of the liquid container within the housing may be adjustable to thereby control the level to which liquid can be discharged into the well formation. The liquid container may be suspended within the housing.

Furthermore, the liquid container may include a sealing member, sealing the outlet opening of the container and that can be pierced upon location of the liquid container in its required configuration within the housing to permit the discharge of liquid from the liquid container into the well formation. As such, a piercing element may be provided within the well formation in a position in which it can pierce the sealing member of the liquid container, upon its location into its required configuration within the housing.

The liquid container either may be refillable or may be disposable.

The liquid displacement means of the liquid dispenser of the invention may be a poriferous element extending from the well formation to the contact member, whereby liquid can be displaced from the well formation to the contact member by a capillary-type action. The poriferous element may be in one piece with the contact member.

Alternatively, the liquid displacement means may be a pump mechanism that can displace liquid from the well formation to a location from which liquid can be displaced by gravity to the contact member. The said location from which liquid can be displaced by gravity to the contact member may be a vessel formation located in the housing operatively above the contact member, permitting displacement of liquid to the contact member via an outlet.

For the above configuration of the liquid displacement means, the contact member may be in communication with the well formation permitting liquid displaced to the contact member to drain from the contact member back to the well formation.

Conveniently, the housing may include a transparent window through which the level of liquid contained within a container within the housing can be rendered visible. Also, the housing may define support means for supporting secondary objects and articles.

Still further according to the invention, the housing may include securing means for securing the housing to a required support wall.

The invention extends also to a liquid container for containing a liquid and including a support formation for supporting the liquid container within the outer housing of a liquid dispenser, in accordance with the present invention, and an outlet opening for discharging liquid from the container into the well formation of the said liquid dispenser.

The outlet opening of the liquid container may be defined at the end of a neck formation projecting from the main container part of the liquid container and the support formation may be defined within a recess at the opposite end of the said main container part, the neck formation and the recess being disposed to permit stacking of liquid containers upon one another.

The liquid container may include a sealing member that blocks off the outlet opening of the liquid container and that can be pierced to permit liquid discharge from the container. Furthermore, the liquid container may include a disposable protective cap that can fit on to the container and protect the sealing member. The disposable protective cap may include a tamper indicating collar for indicating tampering with the container, prior to use.

The liquid container may include reinforcing formations for enhancing the rigidity of the container.

The invention is now described, by way of examples, with reference to the accompanying drawings, in which.

Figure 1:
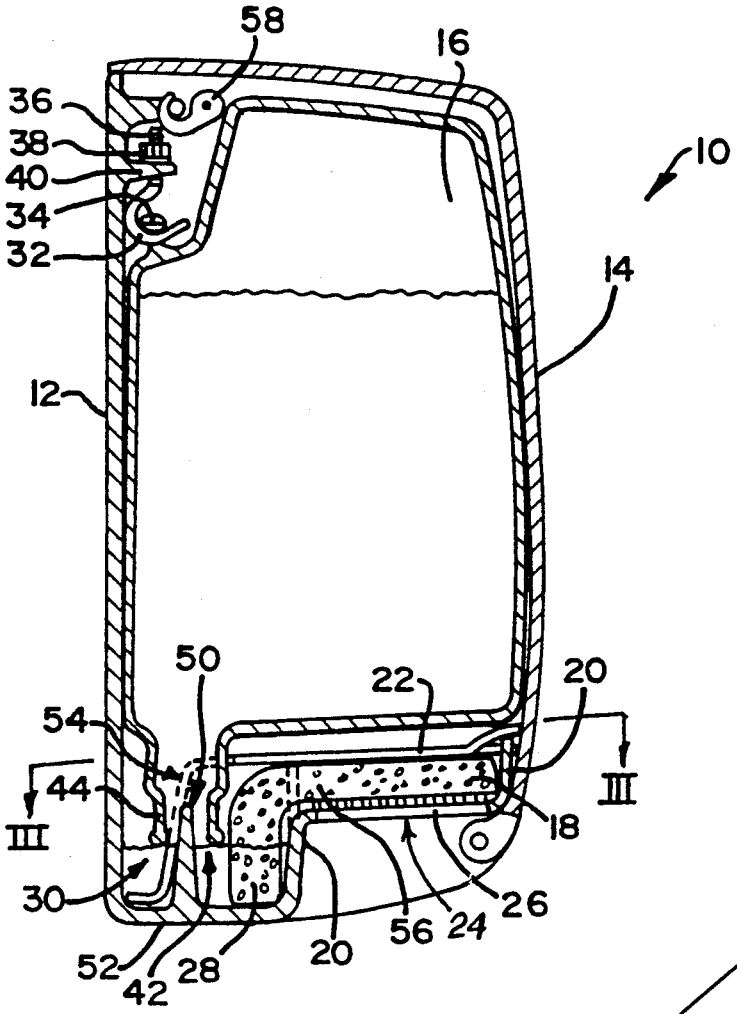
FIG. 1 is a cross-sectional side view of a first embodiment of a liquid dispenser, in accordance with the invention.
Figure 2:
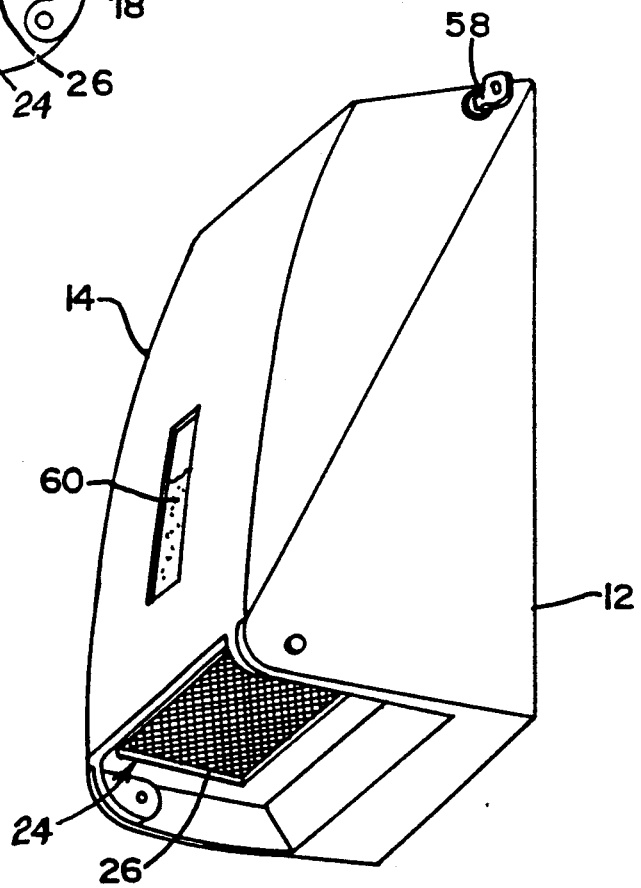
FIG. 2 is an isometric view of the liquid dispenser of FIG. 1.
Figure 3:
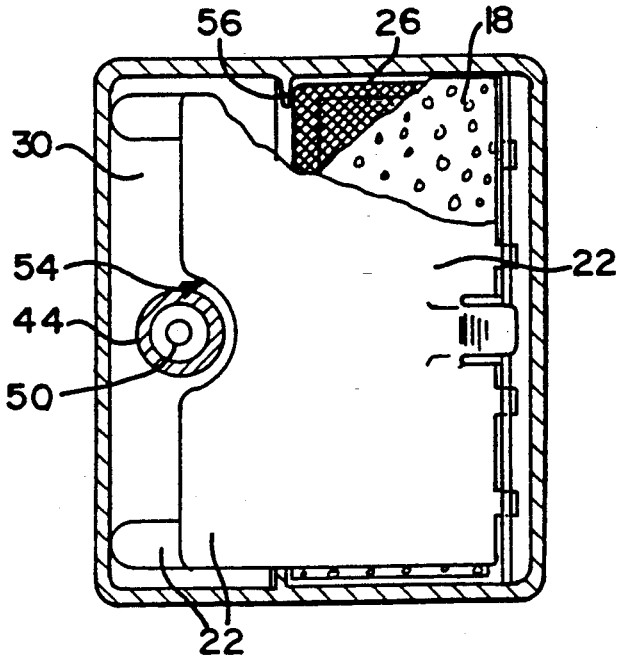
FIG. 3 is a cross-sectional plan view of the liquid dispenser of FIG. 1 along line III—III of FIG. 1.
Figure 4:
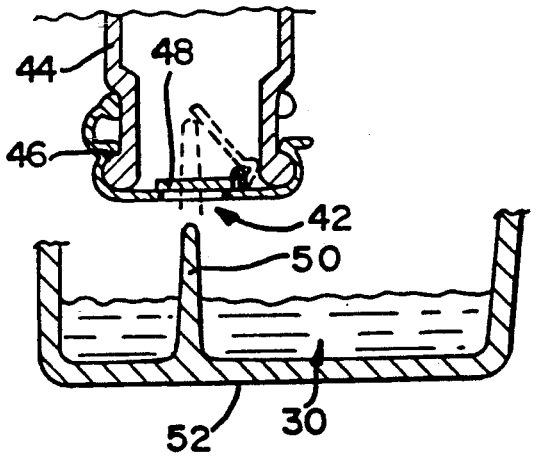
FIG. 4 is a detailed cross-sectional side view of a part of the liquid dispenser of FIG. 1, illustrating a first configuration liquid container for use with the dispenser.

Referring to FIGS. 1 to 6 of the drawings, a liquid dispenser, in accordance with the invention, is generally indicated by the reference numeral 10. The liquid dispenser 10 includes a housing 12 defining formations (not shown) whereby the housing can be mounted onto a support wall, or the like. The said formations may be holes in a wall of the housing 12 or support brackets secured to or forming a part of the housing 12.

The housing 12 has a hinged cover 14 that is hingedly displaceable between a closed position as shown and an open position which permits the removal from or the insertion into the housing 12 of a liquid container 16 which is described in more detail hereafter.

The liquid dispenser 10 further includes a contact member in the form of an open cell type spongy-foam pad 18 which is disposed between a base wall portion 20 of the housing 12 and an opposing element 22 that is securely located within the housing 12. An opening 24 in the base wall portion 20 of the housing 12 provides access to the pad 18, an apertured screen 26 restricting free access to the pad 18 for the purpose described in more detail hereafter.

An extension portion 28 of the pad 18 projects into a well formation 30 defined by the housing 12, this extension portion 28 of the pad 18 permitting wetting of the pad 18 by the transfer of liquid from the well formation 30 to the pad 18 by capillary type liquid transfer, as is well known.

The container 16 is particularly designed to fit snugly into the housing 12 and in one configuration as shown in FIG. 1 is adjustably suspended within the housing 12 via a hook formation 32 that engages an eye or other suitable formation 34 defined as part of the container 16. The exact position of the container 16 within the housing 12 is adjustable by varying the position of the hook formation 32, the hook formation 32 being adjustably secured by a threaded shank 36 and nut 38 that engages a securing bracket 40 that is secured within the housing 12. Clearly, by adjusting the position of the nut 38 on the shank 36, the effective level of the container !6 within the housing is adjustable and, as such, the position of a liquid outlet opening 42 defined by a neck portion 44 of the container 16.

It will be appreciated that liquid contained within the container 16 will fill the well formation 30 for as long as air can replace liquid contained within the container 16, the liquid level within the well formation 30 thus being permitted to rise to a level where the liquid outlet opening 42 is effectively blocked by liquid in the well formation and air can no longer replace liquid discharged from the container 16. As such, the liquid level within the well formation 30 is determined by the position of the liquid outlet opening 42 of the container 16, which in turn is rendered adjustable by the adjustable positioning of the container 16 within the housing 12.

As the transfer of liquid from the well formation 30 to the pad 18 will be determined by the level of liquid within the well formation 30, the dampness of the pad 18, therefore, can also be effectively controlled for purposes hereinafter described.

Figure 6:
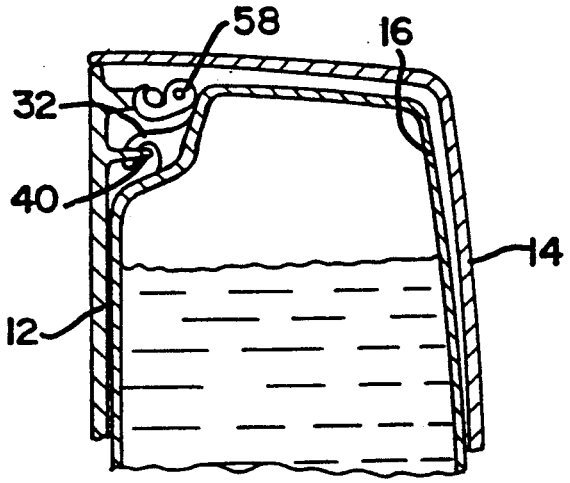
FIG. 6 is a detailed cross-sectional side view of another part of the liquid dispenser of FIG. 1, illustrating an alternative support configuration for a liquid container within the dispenser.

This control over the transfer of liquid to the pad 18 is not considered essential for all applications of the dispenser 10 and, as such, the container 16 can be held in a fixed position in the housing 12. A suitable configuration of the housing 12 and the container 16 for holding the container 16 in a fixed position is shown in FIG. 6, the equivalent parts being designated by the same numerals as before. In this configuration the housing again has a fixed bracket 40 therein whereas the container has a fixed hook formation 32 that can directly engage the bracket 40 as shown.

In order to permit insertion of the container 16 into the housing 12, a snap-on or screw-type sealing cap 46 is provided for the container 16, the cap 46 having a hole therethrough that can be covered by a pivotally displaceable trap door type closure member 48 (see FIG. 4), the closure member 48 clearly preventing the discharge of liquid from the container 16 when held in an inverted configuration during placement of the container 16 into the housing 12. A pin-type formation 50 projects from the base 52 of the well formation 30 and is positioned to pass through the opening in the cap 46 to thereby displace the closure member 48 into its open position as is illustrated in dotted lines in FIG. 4. Clearly, when the closure member is displaced into this open position, liquid contained within the container 16 can be released into the well formation 30, which liquid release will continue until the level of liquid within the well formation 30 reaches the level of the opening defined by the cap 46. A locating formation 54 is defined as part of the opposing element 22 and provides for the neck 44 of the container 16 to be guided into its required position within the well formation 30 in which the formation 50 will project through the opening in the cap 46.

Figure 5:
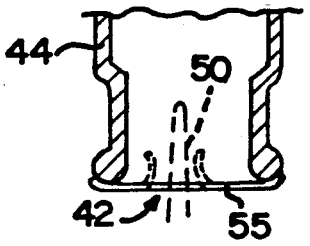
FIG. 5 is a detailed cross-sectional side view of the same part of the liquid dispenser shown in FIG. 4, illustrating a second configuration liquid container for use with the dispenser.

An alternative configuration container 16 for use with the dispenser 10 is shown in FIG. 5, this container having a pierceable sealing member 55 sealing the outlet opening 42 of the container 16. For this container 16, the pin type formation 50 (shown in dotted lines) serves the purposes of a piercing element that will pierce the sealing member 55 upon insertion of the liquid container 16 into the housing 12, thereby initiating the discharge of liquid from the container into the well formation 30 of the dispenser.

It will be appreciated that as a result of the transfer of liquid from the well formation 30 to the contact pad 18, by compressing the pad 18 against the opposing element 22, liquid can be released from the pad 18, typically onto a cleaning rag, cleaning pad, or the like. This liquid release will occur through the screen 26, the screen 26 in fact being displaceably located so that compression of the pad 18 is not impeded thereby. Formations 56 are defined within the housing 12 for restricting the displacement of the screen 26, in this way effectively preventing or reducing tampering with the screen 26 and/or the pad 18.

As liquid is released from the pad 18 in the manner described above, additional liquid will be transferred thereto through the capillary action as described, from the well formation 30, the liquid level within the well formation 30 being continuously controlled insofar as further liquid will be released into the well formation as soon as the level of liquid within the well formation drops below the liquid outlet opening 42 of the container 16.

A window 60 in the cover 14 of the housing 12 is provided to enable checking of the liquid level in the container 16 so that re-filling or replacement of the container can be anticipated.

One typical application of the liquid dispenser is in toilets where it can be provided to dampen cleaning pads whereby toilet seats can be effectively cleaned before use of a toilet. Cleaning pads can be made up of toilet paper that is available, or any other pads that are specifically provided for the purpose, such pads merely being pressed against the screen 26 so that the pad 18 is thereby compressed, which will cause the release of liquid from the pad 18 onto the cleaning pad which can then be used for wiping a toilet seat, or the like. In this way toilet hygiene can be significantly improved, particularly in public toilets, and the like.

It must, however, be appreciated that the liquid dispenser can be used for many other applications such as, for example, in kitchens, children's nurseries, first aid rooms and the like, where the use of damp cleaning pads for wiping objects or surfaces is often necessary and where high hygienic qualities should be continuously preserved.

In order to further improve the tamper proof qualities of the liquid dispenser 10, a lock 58 is provided to lock the cover 14 of the housing 12, thus preventing tampering with the container 16 held within the housing 12. Together with the tamper proof qualities provided by the screen 26, it is believed that the liquid dispenser is suitable for use in public places where it is likely that the dispenser may be subjected to tampering.

It will further be understood that different liquids can be contained within the container 16, particular liquids used clearly being determined by the end applications of the liquid dispenser. This widens the scope of use of the dispenser of the invention.

It will further be appreciated that the exact construction of the liquid dispenser of the invention is greatly variable, both insofar as the features of appearance of the dispenser and the functional features thereof are concerned. For example, an alternative means may be provided for transferring liquid from a container to a spongy type poriferous pad.

Figure 7:
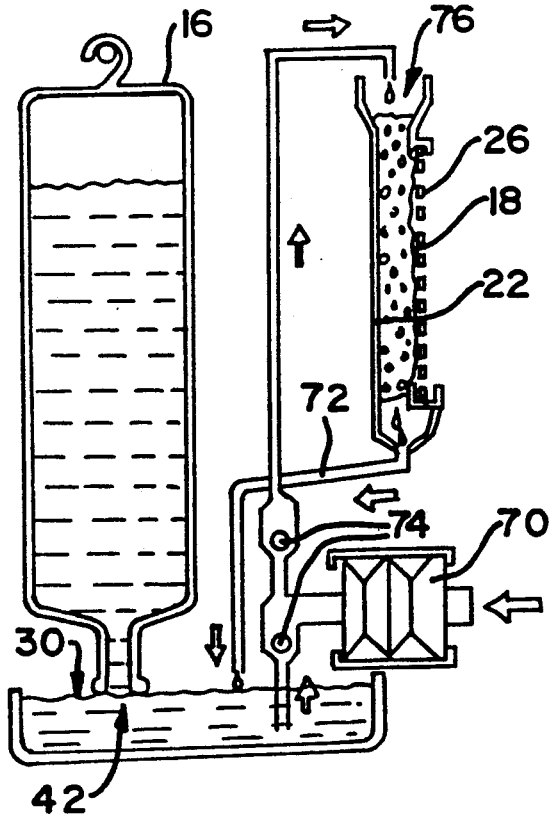
FIG. 7 shows a schematic cross-sectional side view of a second embodiment of a liquid dispenser, in accordance with the invention.

Such an alternative means for transferring liquid to a spongy type poriferous pad is schematically illustrated in FIG. 7 of the drawings. This liquid transfer means includes a positive displacement bellows-type liquid pump 70 whereby liquid is displaceable to a location above the pad 18, this pad 18, in this embodiment, being accessible via an opening in the operative front face of the housing. The pad 18 is again located between a screen 26 and an opposing element 22 to permit compression thereof and the release of liquid therefrom. In this embodiment liquid displaced to the said location above the pad 18 will drain through the pad 18 to wet the pad, liquid not released from the pad draining back to the well formation 30 via a conduit 72. One-way ball-valves 74 will ensure the effective operation of the pump 70, the location above the pad 18 to which liquid is displaced being a vessel formation 76.

Other configurations of liquid displacement means are envisaged and the invention extends also to such configurations of liquid displacement means that incorporate the general principles of a liquid displacement means for use with a dispenser in accordance with this invention.

It will be understood that the design of the container 16 is determined by the configuration of the housing 12 of the dispenser. Also, the container may be refillable or disposable. Disposable containers can be marked with suitable liquids contained therein, containers merely being replaced when empty. These containers have their hook formations 32 disposed within recesses defined in the base regions of the containers, these recesses being adapted to accommodate the necks 44 of like containers to enable effective stacking of the containers. Tamper proof closures may be associated with these containers, the said closures also protecting sealing members 55, when provided for sealing containers 16.

I claim:

1. A liquid dispenser, which includes an outer housing for supporting a liquid container therein in an inverted configuration, the housing including a well formation into which liquid contained in a liquid container supported in the housing can be discharged to controlled levels;

a contact member of a poriferous material located within the housing and defining a region that is exposed by a first opening in a wall of the housing and that is disposed operatively higher than the controlled liquid levels to which liquid can be discharged into the well formation, the contact member being resiliently compressible permitting the release of liquid contained therein by compression thereof via the first opening in a wall of the housing; and liquid displacement means for displacing liquid contained in the well formation to the region of the contact member that is exposed.

2. A liquid dispenser as claimed in claim 1, in which the housing has a cover displaceable between an open position in which a liquid container can be inserted into the housing, or removed therefrom, and a closed position.

3. A liquid dispenser as claimed in claim 2 which includes locking means for locking the cover in its closed position.

4. A liquid dispenser as claimed in claim 1, in which the contact member is of a sponge-like material.

5. A liquid dispenser as claimed in claim 1, which includes an apertured screen covering the first opening, the apertured configuration of the screen providing the necessary access to the contact member for the release of liquid therefrom.

6. A liquid dispenser as claimed in claim 5, in which the screen is resiliently deformable to permit resilient compression of the contact member.

7. A liquid dispenser as claimed in claim 5, in which the screen is displaceably located to permit resilient compression of the contact member.

8. A liquid dispenser as claimed in claim 5, which includes an opposing element, positioned so that the contact member is disposed between the opposing element and the screen, the opposing element locating the contact member in position and permitting compression of the contact member.

9. A liquid dispenser as claimed in claim 1, which includes a liquid container having an outlet opening, the liquid container being adapted to be housed within the housing in a required inverted configuration in which liquid can be discharged into the well formation to a desired level within the well formation as determined by the level of the outlet opening of the container within the well formation.

10. A liquid dispenser as claimed in claim 9, in which the position of the liquid container within the housing is adjustable to thereby control the level to which liquid can be discharged into the well formation.

11. A liquid dispenser as claimed in claim 10, in which the liquid container is suspended within the housing.

12. A liquid dispenser as claimed in claim 9, in which the liquid container includes a sealing member sealing the outlet opening of the container and that can be pierced upon location of the liquid container in its required configuration within the housing to permit the discharge of liquid from the liquid container into the well formation.

13. A liquid dispenser as claimed in claim 12, which includes a piercing element located within the well formation in a position in which it can pierce the sealing member of the liquid container upon its location into its required configuration within the housing.

14. A liquid dispenser as claimed in claim 9, in which the liquid container is refillable.

15. A liquid dispenser as claimed in claim 9, in which the liquid container is disposable.

16. A liquid dispenser as claimed in claim 1, in which the liquid displacement means is a poriferous element extending from the well formation to the contact member, whereby liquid can be displaced from the well formation to the contact member by a capillary-type action.

17. A liquid dispenser as claimed in claim 16, in which the poriferous element is in one piece with the contact member.

18. A liquid dispenser as claimed in claim 1, in which the liquid displacement means is a pump mechanism that can displace liquid from the well formation to a location from which liquid can be displaced by gravity to the contact member.

19. A liquid dispenser as claimed in claim 18, in which the said location from which liquid can be displaced by gravity to the contact member is a vessel formation located in the housing operatively above the contact member, permitting displacement of liquid to the contact member via an outlet.

20. A liquid dispenser as claimed in claim 18, in which the contact member is in communication with the well formation permitting liquid displaced to the contact member to drain from the contact member back into the well formation.

21. A liquid dispenser as claimed in claim 1, in which the housing includes a transparent window through which the level of liquid contained within a container within the housing can be rendered visible.

* * * * *